US011357676B1

(12) United States Patent
Spencer, Jr. et al.

(10) Patent No.: US 11,357,676 B1
(45) Date of Patent: Jun. 14, 2022

(54) APPARATUS TO LOAD AND UNLOAD A MOBILITY DEVICE

(71) Applicants: Charles Winfield Spencer, Jr., Dundalk, MD (US); Charles Winfield Spencer, Dundalk, MD (US)

(72) Inventors: Charles Winfield Spencer, Jr., Dundalk, MD (US); Charles Winfield Spencer, Dundalk, MD (US)

( * ) Notice: Subject to any disclaimer, the term of this patent is extended or adjusted under 35 U.S.C. 154(b) by 0 days.

(21) Appl. No.: 17/480,115

(22) Filed: Sep. 20, 2021

(51) Int. Cl.
*A61G 3/06* (2006.01)

(52) U.S. Cl.
CPC ..... *A61G 3/062* (2013.01); *A61G 2220/14* (2013.01)

(58) Field of Classification Search
CPC ..... A61G 3/0209; A61G 3/02; A61G 3/062; A61G 2200/34; A61G 7/1017; B60P 1/4442; B60P 1/4407; B60P 1/4428; B60P 1/4414; B60P 3/1016; B60P 3/1025; B60P 3/06; B60P 3/07; B60R 9/0426; B60R 9/0423; B60R 2011/0085
USPC ..... 414/462, 465, 541, 921, 540, 477, 478; 212/294, 259, 260, 261
See application file for complete search history.

(56) References Cited

U.S. PATENT DOCUMENTS 2,683,540 A * 7/1954 Wood ..... B60P 1/4414 414/557
4,147,261 A * 4/1979 Dautel ..... B60P 1/4478 414/557
6,042,327 A * 3/2000 DeLeo ..... B60P 1/4457 414/540
8,221,048 B2 * 7/2012 Grollitsch ..... B60P 1/483 414/546
2006/0045692 A1 * 3/2006 Mills ..... B60P 1/6463 414/477
2006/0120841 A1 * 6/2006 Meeks ..... B60P 1/4407 414/462
2009/0016866 A1 1/2009 Zaragoza
2015/0147144 A1 * 5/2015 Frazier ..... B60P 1/43 414/495
2021/0108420 A1 * 4/2021 Beiler ..... B65G 11/14

FOREIGN PATENT DOCUMENTS

DE 202014100151 4/2015

OTHER PUBLICATIONS

Ladeboy, Rausch-Technik.
Carolift Wheelchair Hoists, Braunability.

* cited by examiner

*Primary Examiner* — Glenn F Myers

(57) ABSTRACT

An apparatus to load and unload a mobility device includes a base, a first actuating assembly, a second actuating assembly, a shuttle, and a lift arm assembly. The first actuating assembly and the second actuating assembly are oppositely positioned of each other about the base so that a linear actuator of the first actuating assembly and the second actuating assembly can rotatably mount to the base about a first rotational axis. Rotation of the linear actuators moves up and down the lift arm assembly as the linear actuator of the first actuating assembly and the second actuating assembly are rotatably mounted to the lift arm assembly about a second rotational axis. The shuttle that receives the mobility device is rotatably mounted to the lift arm assembly about a third rotational axis so that the mobility device can be loaded and unloaded from a cargo space of a transportation vehicle.

7 Claims, 12 Drawing Sheets

APPARATUS TO LOAD AND UNLOAD A MOBILITY DEVICE

FIELD OF THE INVENTION

The present invention generally relates to a loading apparatus. More specifically, the present invention is able to load and unload a mobility device to a cargo space of a transportation vehicle.

BACKGROUND OF THE INVENTION

People with mobility, circulatory, respiratory, or neurological disabilities use many kinds of mobility devices for mobility. Some use walkers, canes, crutches, or braces. Some use non-electrical or power wheelchairs, walkers, or electric scooters. In addition, advances in technology have given rise to new devices, such as a self-balancing personal transporter. Loading and unloading of the aforementioned mobility devices are generally completed via electric/manual lifts, ramps, or electric/manual hoists that can be mounted to a transportation vehicle. However, current loading and unloading devices can be cumbersome and may not fit within some residential vehicles such as a car or midsize SUV. Furthermore, some of the current loading and unloading devices may require some level of user interactions such as lifting or balancing during the unloading or loading process. Depending upon the type of disability, user interaction can be somewhat difficult for some users. Furthermore, some of the current loading and unloading devices are not able to store the mobility device within the transportation vehicle thus exposing the mobility device for elements such as rain and dust.

It is an objective of the present invention to provide a solution for aforementioned problem as the present invention ease the loading and unloading of the mobility device into a transportation vehicle. More specifically, the present invention is able to store the mobility device within the cargo space of the transportation vehicle. Furthermore, the present invention utilizes the least amount of user interactions as the loading and unloading process of mobility device is electrically powered. Furthermore, the present invention provides an affable solution that can be easily mounted within residential vehicles such as a car or midsize SUV.

DETAIL DESCRIPTIONS OF THE INVENTION

Figure 1:
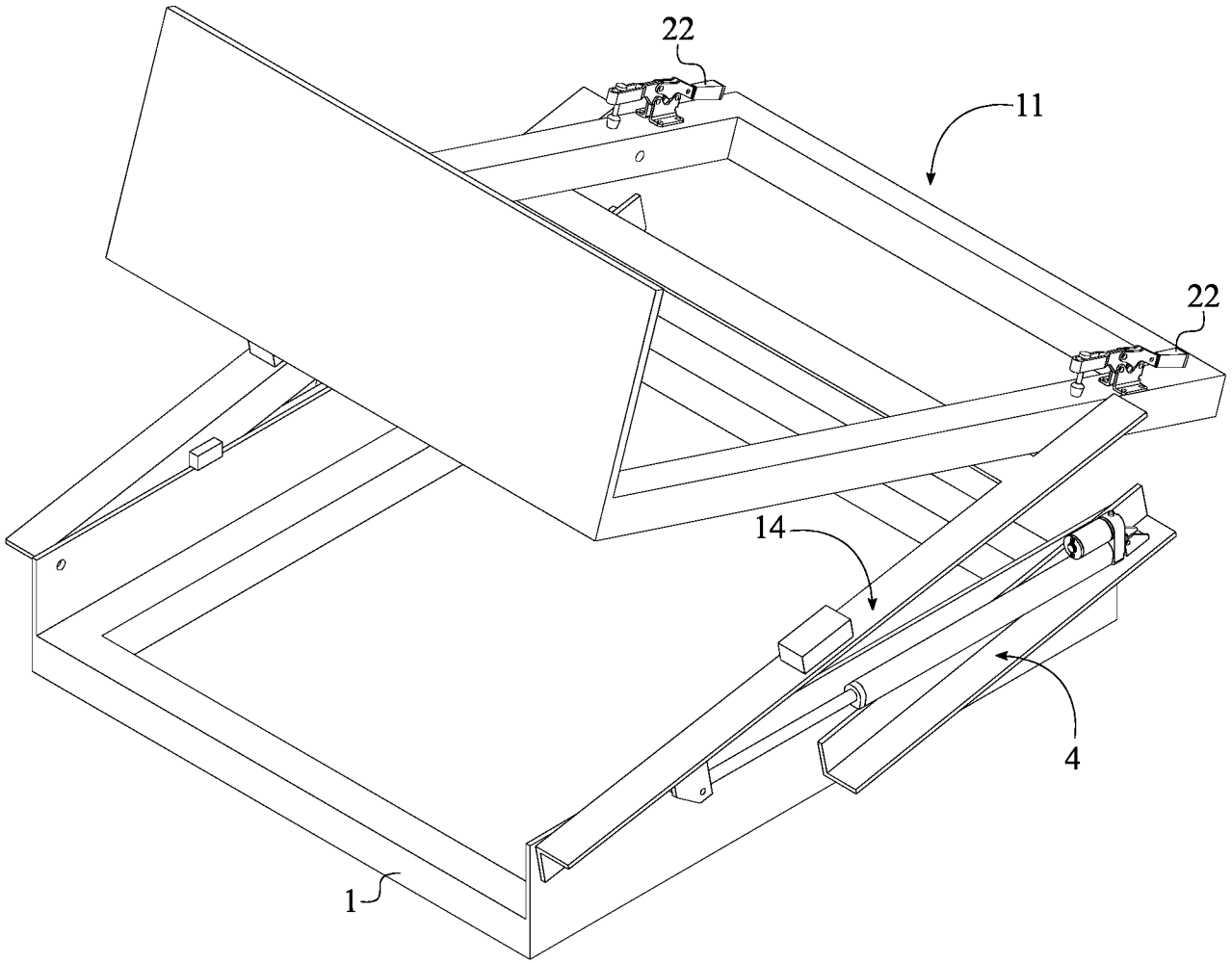
FIG. 1 is a top perspective view of the present invention in the closed position.

All illustrations of the drawings are for the purpose of describing selected versions of the present invention and are not intended to limit the scope of the present invention.

The present invention an apparatus for load and unload a mobility device into a transportation vehicle. More specifically, the present invention can be retrofitted into a cargo space of many residential vehicles such as a car or midsize SUV so that the mobility device can be stored within the transportation vehicle.

As shown in FIG. 1-4, the present invention comprises a base 1, a first actuating assembly 4, a second actuating assembly 5, a shuttle 11, and a lift arm assembly 14. In reference to general configuration of the present invention, the first actuating assembly 4 and the second actuating assembly 5 are oppositely positioned of each other about the base 1. A linear actuator 6 of the first actuating assembly 4 and the second actuating assembly 5 are rotatably mounted to the base 1 about a first rotational axis 23 thus allowing the linear actuator 6 of the first actuating assembly 4 and the second actuating assembly 5 simultaneously rotate around the first rotational axis 23 in the clockwise direction or the counterclockwise direction. The lift arm assembly 14 is rotatably mounted to base 1 about the second rotational axis 24, wherein the lift arm assembly 14 rotates around the second rotational axis 24 in the clockwise direction or the counterclockwise direction. Furthermore, the linear actuator 6 of the first actuating assembly 4 and the second actuating assembly 5 are operatively coupled to the lift arm assembly 14 so that the linear actuator 6 can apply rotational force to the lift arm assembly 14. The shuttle 11 is rotatably mounted the lift arm assembly 14 about a third rotational axis 25 so that the shuttle 11 can rotate around the third rotational axis 25 in the clockwise direction or the counterclockwise direction.

When the present invention changes from a closed position to an expanded position, the linear actuator 6 of the first actuating assembly 4 and the second actuating assembly 5 simultaneously rotate in the counterclockwise direction and around the first rotational axis 23. As a result, the first actuating assembly 4 and the second actuating assembly 5 move upward thus rotating the lift arm assembly 14 in the clockwise direction and around second rotational axis 24. Simultaneously, the shuttle 11 rotates in the counterclockwise direction and around the third rotational axis 25. Due to the counterclockwise rotation of the shuttle 11 and the clockwise rotation of the lift arm assembly 14, the shuttle 11 is first lifted away from the base 1 and then lowered through an opening of the cargo space of the transportation vehicle so that the mobility device can be removed or loaded.

When the present invention changes from the expanded position to the closed position, the linear actuator 6 of the first actuating assembly 4 and the second actuating assembly 5 simultaneously rotate in the clockwise direction and around the first rotational axis 23. As a result, the first actuating assembly 4 and the second actuating assembly 5 move downward thus rotating the lift arm assembly 14 in the counterclockwise direction and around second rotational axis 24. Simultaneously, the shuttle 11 rotates in the clockwise direction and around the third rotational axis 25. Due to the clockwise rotation of the shuttle 11 and the counterclockwise rotation of the lift arm assembly 14, the shuttle 11 is first lifted away from the opening of the cargo space of the transportation vehicle and then lowered toward the base 1 so that the mobility device can be stored.

Figure 2:
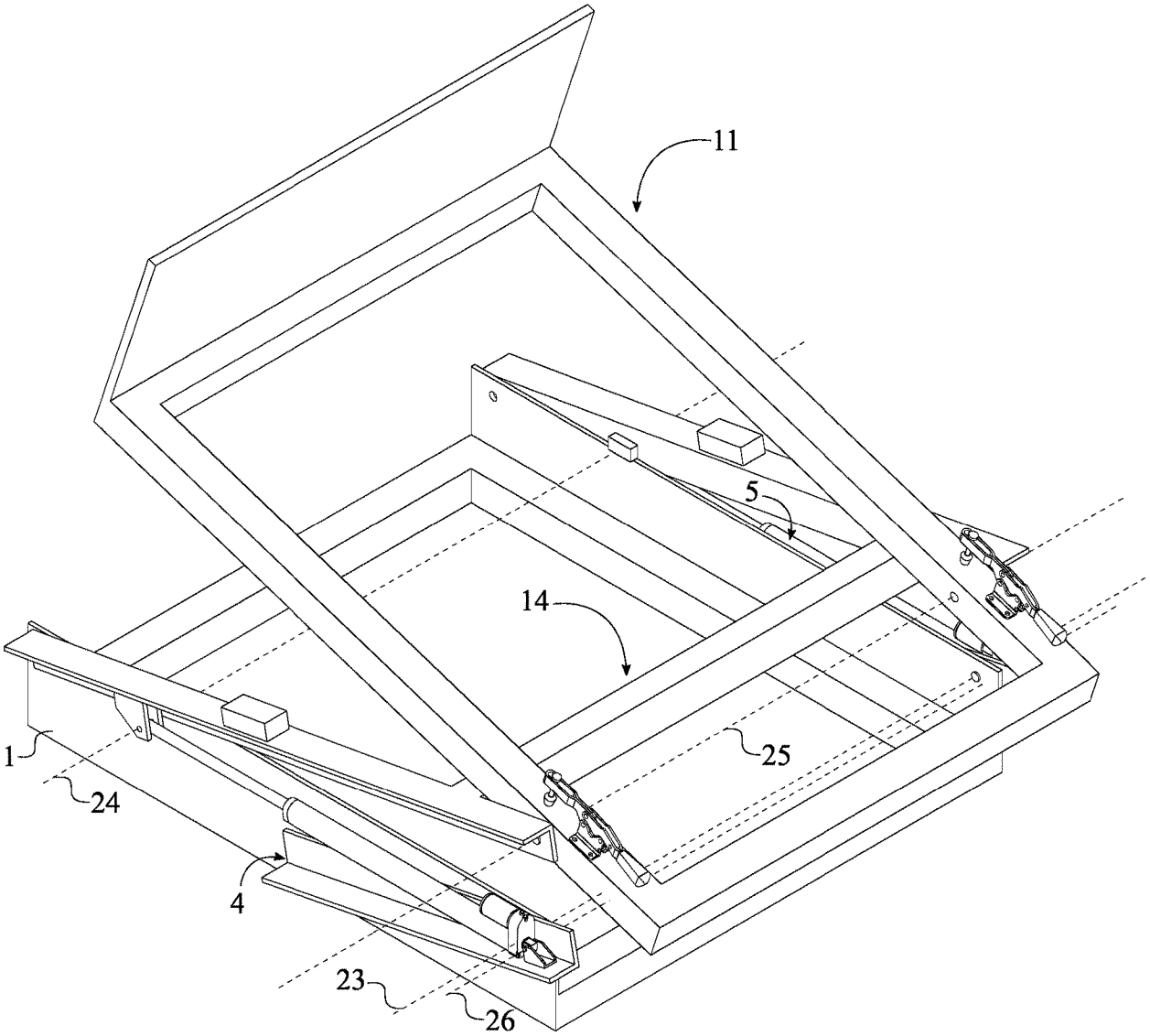
FIG. 2 is another top perspective view of the present invention in the closed position.

In reference to FIG. 1-2, the base 1 is a rectangular structural body that can withstand the weight and the movements of the present invention. The base 1 is mounted to an existing floor of the cargo space of the transportation vehicle or a replacement floor that is designed to cover the access spare tire opening. More specifically, a front end 2 of the base 1 is preferably positioned adjacent to the opening of the cargo space. A rear end 3 of the base 1 is preferably positioned adjacent to the rear seat of the transportation vehicle. Furthermore, the first rotational axis 23 is perpendicularly positioned across the rear end 3 of the base 1. The second rotational axis 24 is perpendicularly positioned across the front end 2 of the base 1.

The first actuating assembly 4 and the second actuating assembly 5 function as the actuating arms that moves the present invention between the closed position and the expanded position. In reference to FIG. 3-4, the first actuating assembly 4 and the second actuating assembly 5 each further comprises a push bracket 9 and a pivot kick arm 10 in addition to the linear actuator 6. The push bracket 9 and the linear actuator 6 are positioned along the pivot kick arm 10 so that the activation of the linear actuator 6 is able to rotate the pivot kick arm 10. The push bracket 9 is hingedly mounted to a housing 7 of the linear actuator 6 so that the push bracket 9 and the linear actuator 6 can independently operate from each other. The push bracket 9 is connected onto the pivot kick arm 10 as the housing 7 of the linear actuator 6 is rotatably mounted to the base 1 about the first rotational axis 23. More specifically, the push bracket 9 is hingedly mounted to the housing 7 of the linear actuator 6 about a fourth rotational axis 26 of the present invention. As a result, the linear actuator 6 is able to rotate around the first rotational axis 23 while the movement of the push bracket 9 directly causes the pivot kick arm 10 to rotate about the fourth rotational axis 26. In order to rotate the lift arm assembly 14 and the shuttle 11 with respect to their corresponding rotational directions, to the lift arm assembly 14 is rotatably mounted a telescopic rod 8 of the linear actuator 6.

Figure 3:
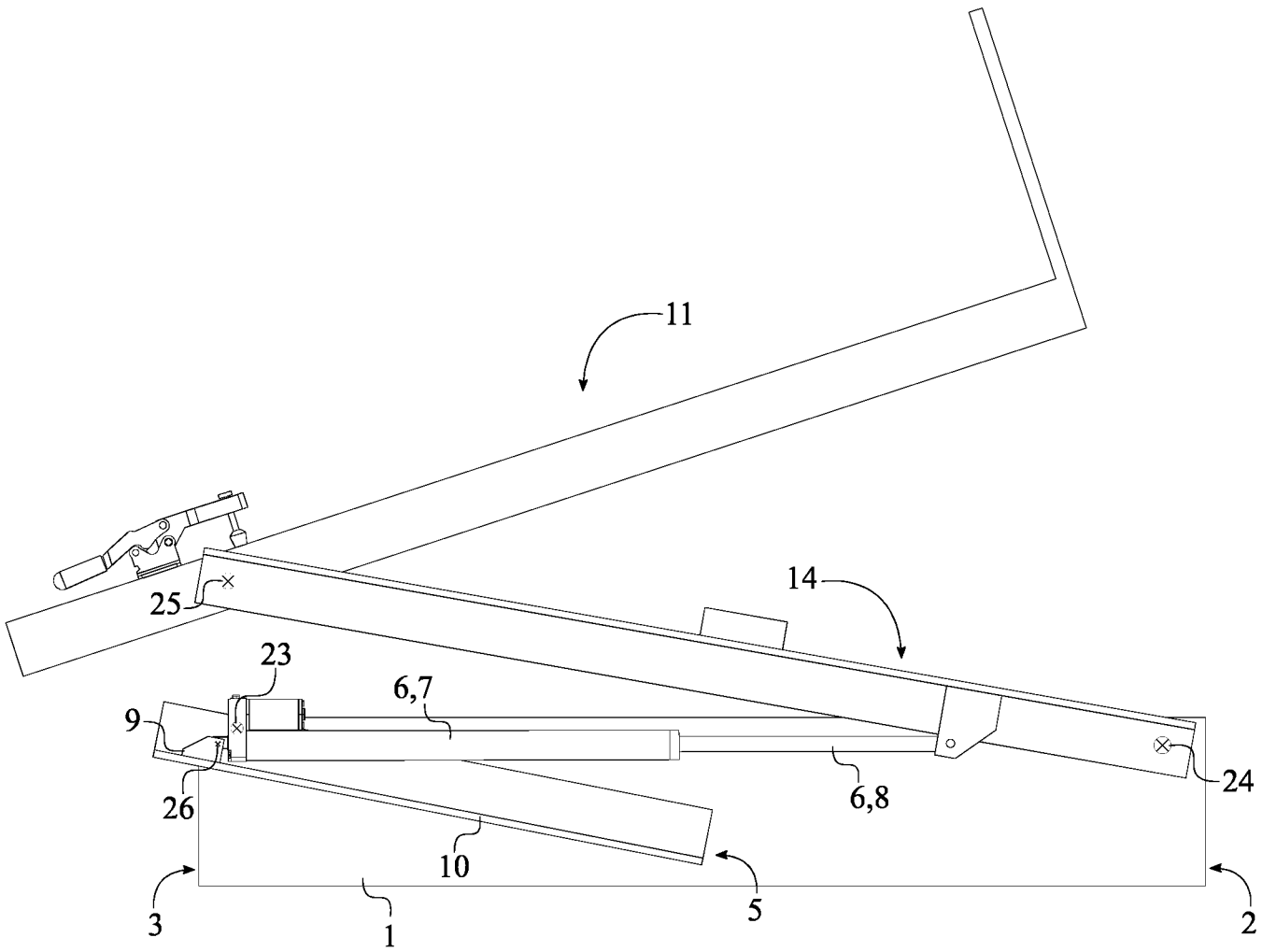
FIG. 3 is a side view of the present invention in the closed position, showing the components of the second actuating assembly.
Figure 4:
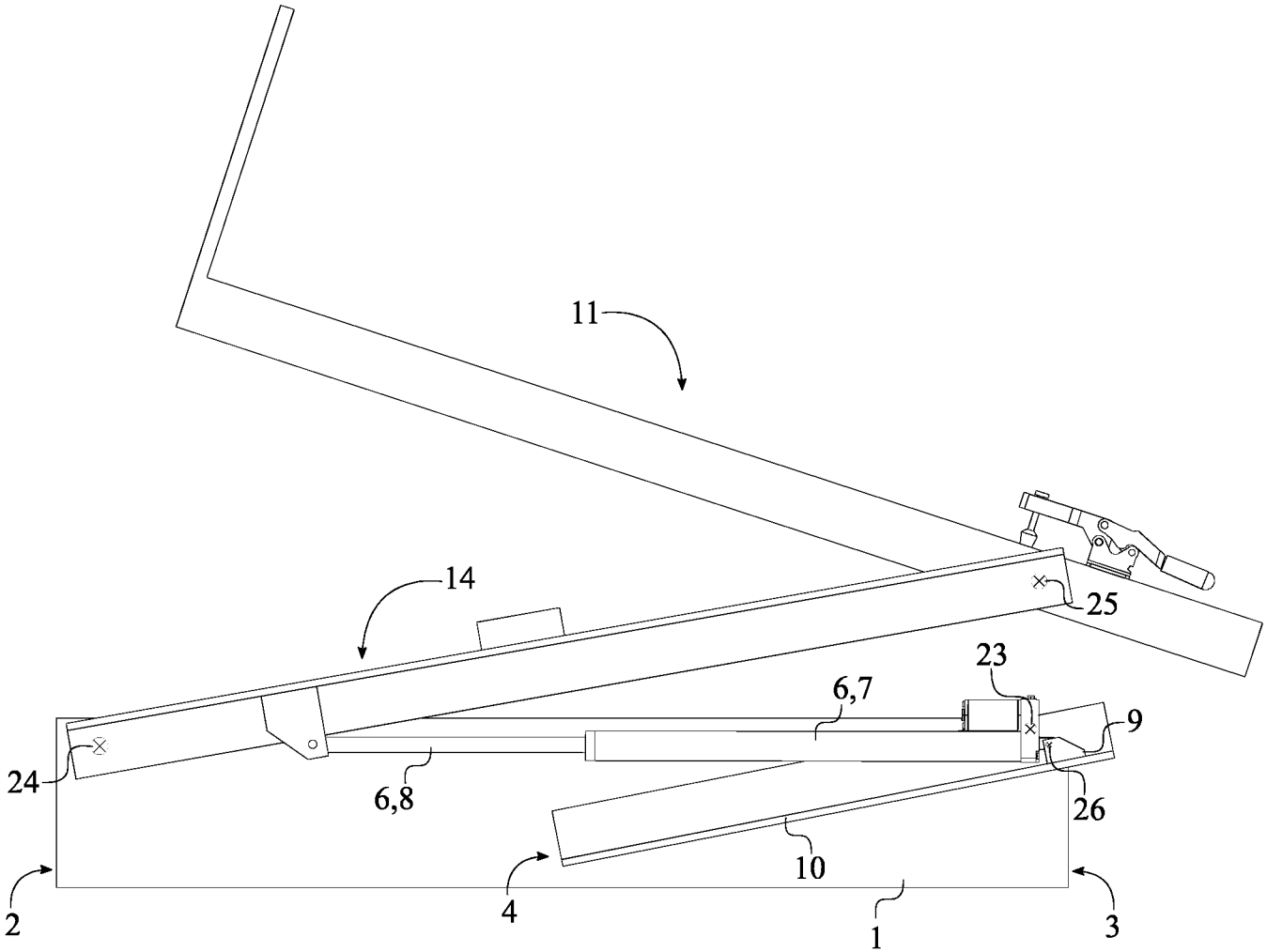
FIG. 4 is a side view of the present invention in the closed position, showing the components of the first actuating assembly.
Figure 7:
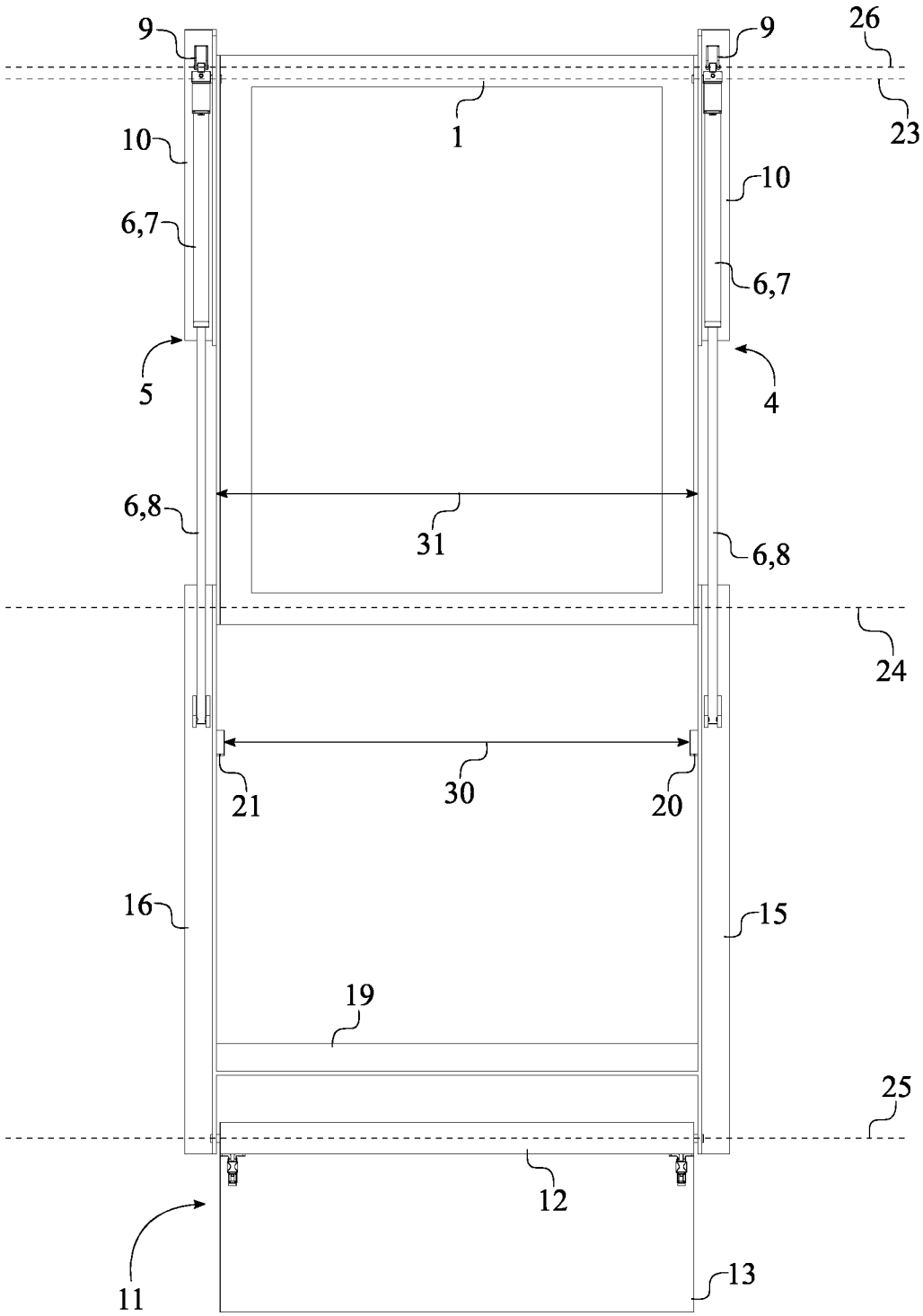
FIG. 7 is a top view of the present invention in the expanded position.

In reference to FIGS. 3-4 and FIG. 7, the fourth rotational axis 26 is positioned across the pivot kick arm 10 of the first actuating assembly 4 and the second actuating assembly 5 and positioned adjacent to the first rotational axis 23. The first rotational axis 23 and the second rotational axis 24 are positioned coplanar to each other and rotate in opposite rotational directions due to the operation of the first actuating assembly 4 and the second actuating assembly 5. The fourth rotational axis 26 is positioned offset from the first rotational axis 23 and rotate in the same rotational direction as the first rotational axis 23 so that the rotational force of the pivot kick arm 10 can initiate and assist the rotation of the linear actuator 6.

As shown in FIG. 8-11, when the linear actuator 6 is powered and the telescopic rod 8 outwardly extends from the housing 7, the offset positioning of the fourth rotational axis 26 and the first rotational axis 23 force the housing 7 to push down on the pivot kick arm 10. Downward pressure of the housing 7 then forces the pivot kick arm 10 to rotate in the counterclockwise direction until the pivot kick arm 10 engages with the housing 7. The pivot kick arm 10 then assists the counterclockwise rotation of the housing 7. As a result, the linear actuator 6 is able to rotate in the counterclockwise direction which in turn rotates the lift arm assembly 14 in the clockwise direction. Once the downward pressure of the housing 7 is released from the pivot kick arm 10, the pivot kick arm 10 returns to the initial resting position.

When the linear actuator 6 is powered and the telescopic rod 8 inwardly moves toward the housing 7, the offset positioning of the fourth rotational axis 26 and the first rotational axis 23 force the housing 7 to push down on the pivot kick arm 10. Downward pressure of the housing 7 then forces the pivot kick arm 10 to rotate in the counterclockwise direction until the pivot kick arm 10 engages with the housing 7. The pivot kick arm 10 then assists the clockwise rotation of the housing 7. As a result, the pivot kick arm 10 is able to provide a control descent for the clockwise rotation of the linear actuator 6 which in turn rotates the lift arm assembly 14 in the counterclockwise direction. Once the downward pressure of the housing 7 is released from the pivot kick arm 10, the pivot kick arm 10 returns to the initial resting position.

The linear actuator 6 is electrically connected to an external power source so that the linear actuator 6 can be powered within the present invention. For example, the external power source can be a standalone battery, a power outlet of the transportation vehicle, or any other type of power source within the industry.

Figure 5:
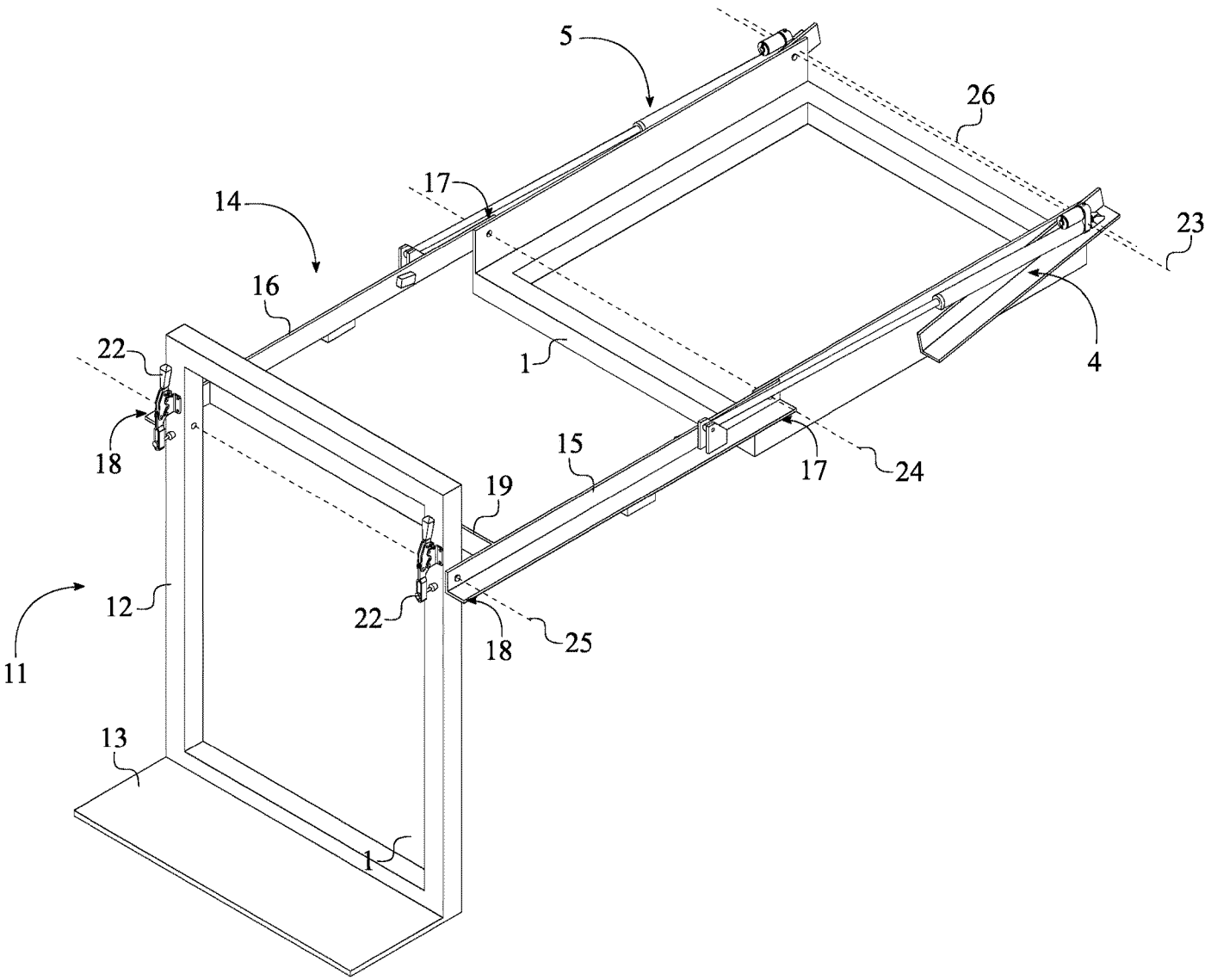
FIG. 5 is a top perspective view of the present invention in the expanded position.
Figure 12:
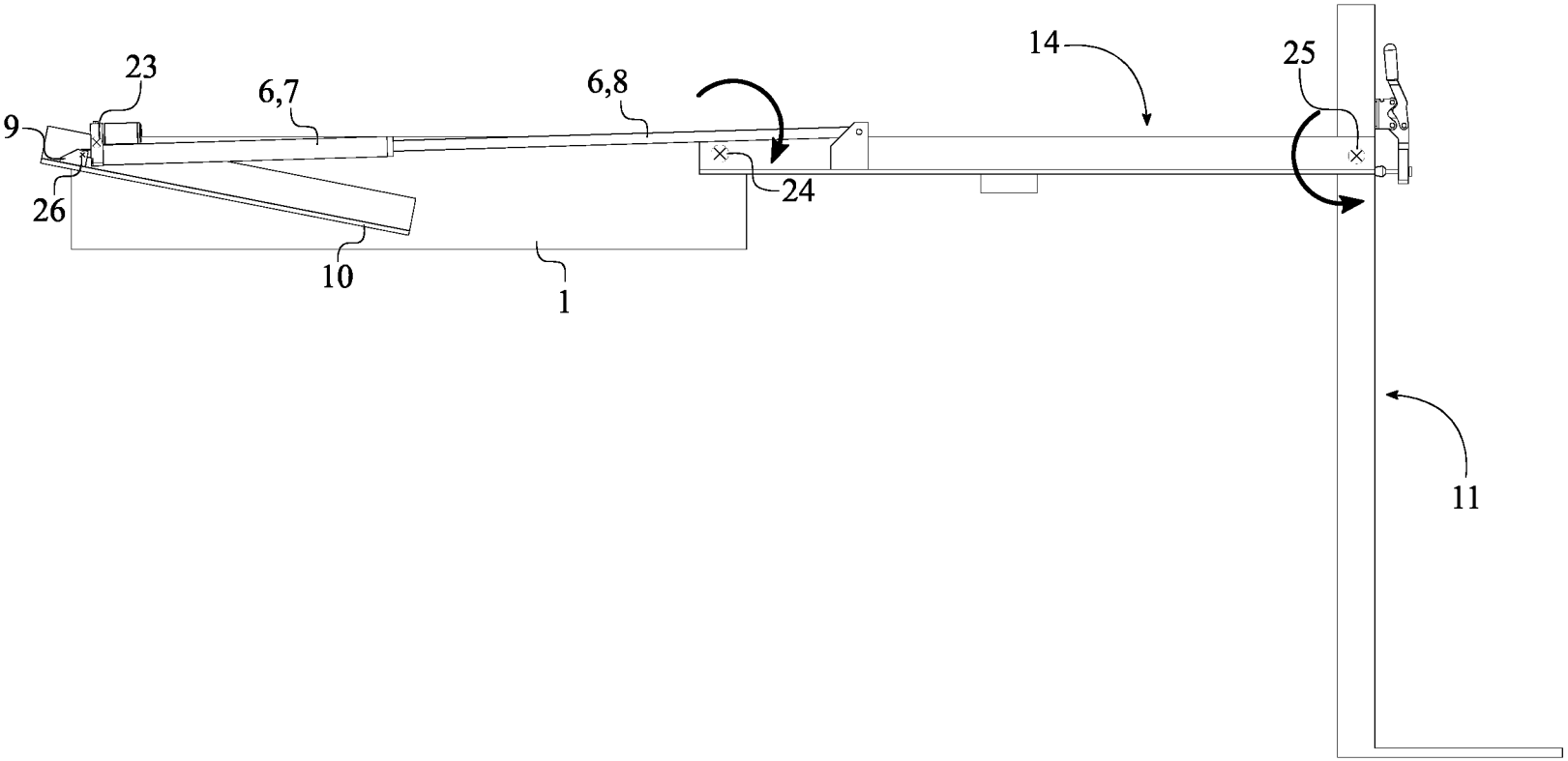
FIG. 12 is a side view of the present invention changing from the closed position to the expanded position, wherein the clockwise rotation of the lift arm assembly initiate the shuttle to rotate in counterclockwise direction until the present invention reaches the expanded position.

In reference to FIG. 5 and FIG. 7, the lift arm assembly 14 comprises a first arm 15, a second arm 16, a cross plate 19, a first stop 20, and a second stop 21. The first arm 15 and the second arm 16 are positioned parallel to each other about the cross plate 19 that enables the shuttle 11 to angularly position atop the base 1. More specifically, the cross plate 19 is terminally connected to the first arm 15 from one end. The cross plate 19 is terminally connected to the second arm 16 from the opposite end. The cross plate 19 is positioned adjacent to a distal end 18 of the first arm 15 and the second arm 16 so that the shuttle 11 can be rotatably mounted adjacent to the distal end 18 of the first arm 15, the distal end 18 of the second arm 16, and the cross plate 19. As a result, the shuttle 11 continually lays upon the cross plate 19 and angularly positioned to the first arm 15 and the second arm 16. In order to attain the correct rotational direction for the shuttle 11, a proximal end 17 of the first arm 15 is rotatably mounted to the base 1 about the second rotational axis 24. A proximal end 17 of the second arm 16 is rotatably mounted to the base 1 about the second rotational axis 24. As a result, when the lift arm assembly 14 rotates in the clockwise direction, the shuttle 11 rotates in the counterclockwise direction due to the placement of the cross plate 19, as shown in FIG. 12. Similarly, when the lift arm assembly 14 rotates in the counterclockwise direction, the shuttle 11 rotates in the clockwise direction due to the placement of the cross plate 19.

In reference to FIG. 7, the first stop 20 is laterally connected to the first arm 15 and oriented toward the base 1. The second stop 21 being laterally connected to the second arm 16 and oriented toward the base 1. The first stop 20 and the second stop 21 function as structural barriers so that the counterclockwise rotation of the lift arm assembly 14 can be halted with respect to the base 1 as a distance 30 between the first stop 20 and the second stop 21 is smaller than a width 31 of the base 1. More specifically, when the first stop 20 engages with the base 1, the first stop 20 halts the counterclockwise rotation of the first arm 15. When the second stop 21 engages with the base 1, the second stop 21 halts the counterclockwise rotation of the second arm 16.

Figure 8:
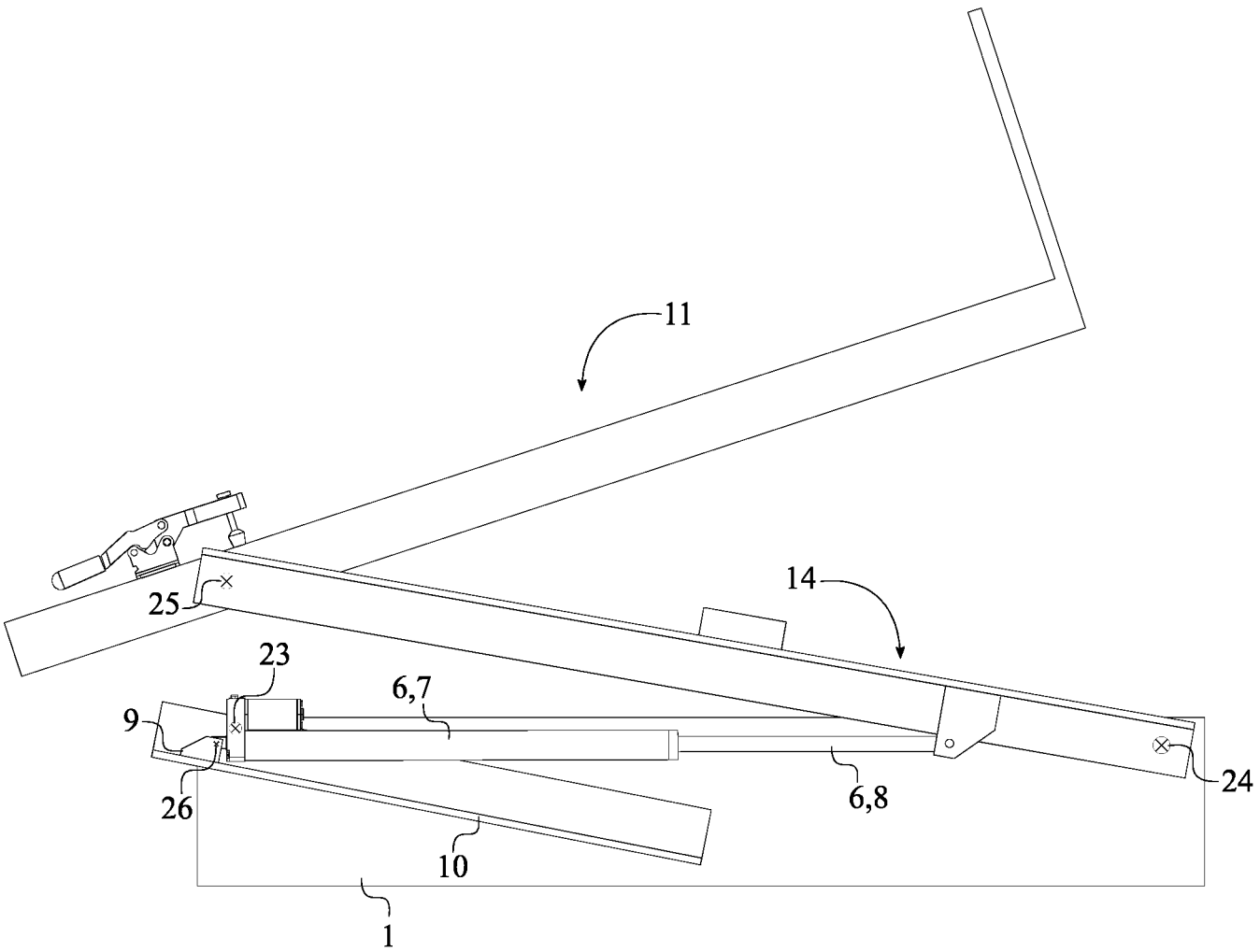
FIG. 8 is a side view of the present invention in the closed position.
Figure 9:
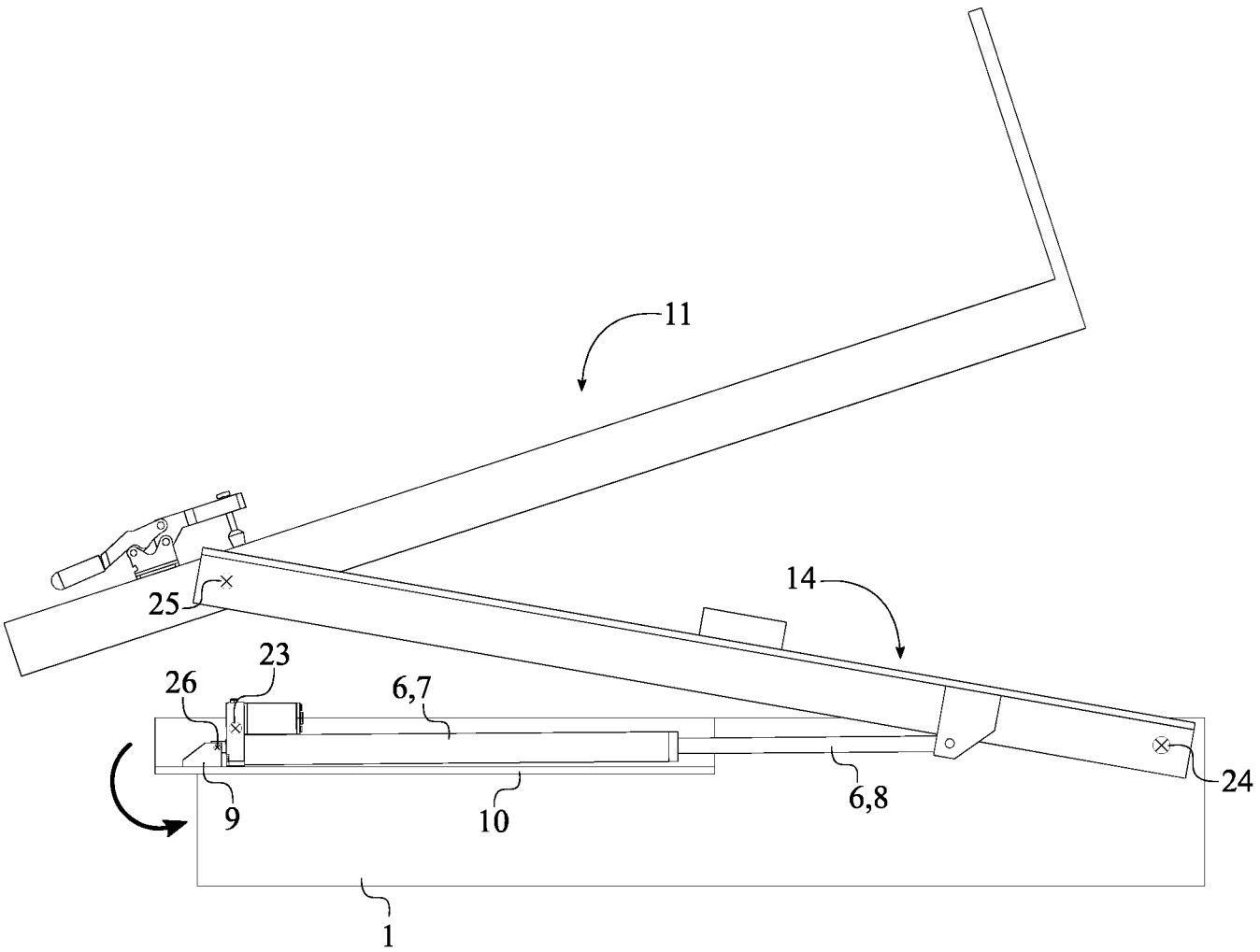
FIG. 9 is a side view of the present invention changing from the closed position to the expanded position, wherein the pivot kick arm rotates in the counterclockwise direction until the engagement of the housing.
Figure 10:
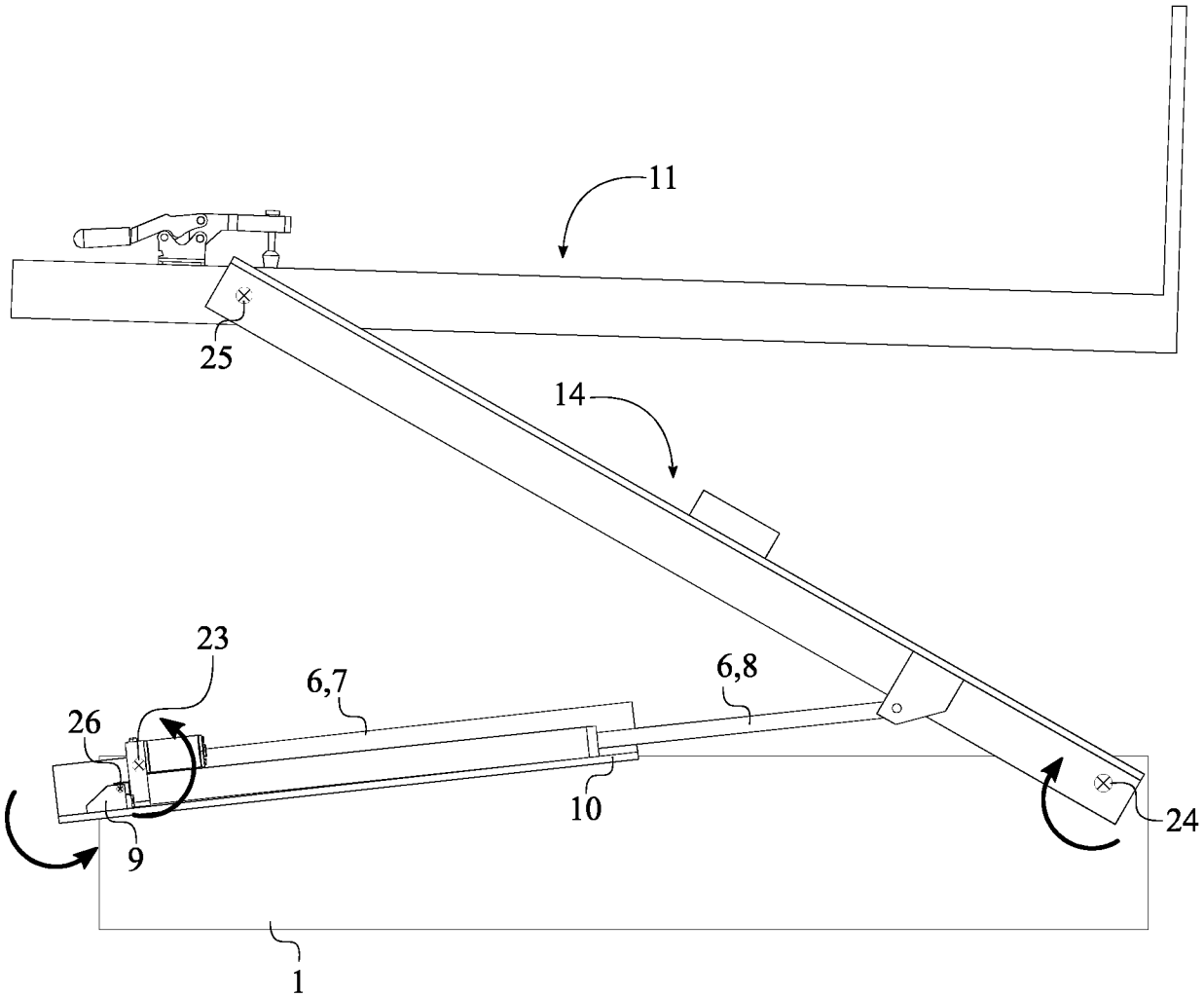
FIG. 10 is a side view of the present invention changing from the closed position to the expanded position, wherein the pivot kick arm rotates in the counterclockwise direction to assists the counterclockwise rotation of the housing and to clockwise rotation of the lift arm assembly.
Figure 11:
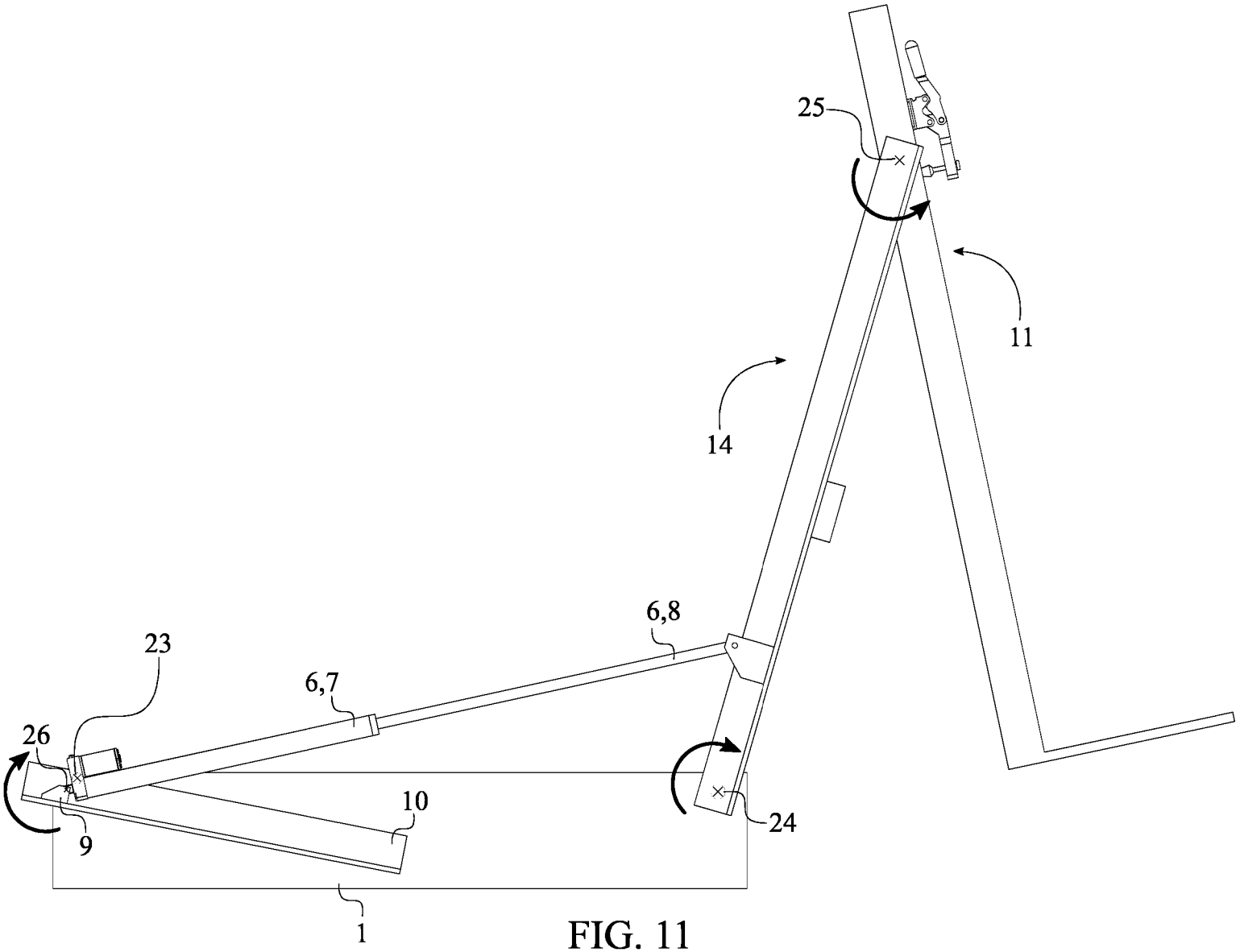
FIG. 11 is a side view of the present invention changing from the closed position to the expanded position, wherein the pivot kick arm rotates back to the initial resting position in the clockwise direction and the clockwise rotation of the lift arm assembly initiate the shuttle to rotate in counterclockwise direction.

The shuttle 11 that provides the necessary surface area to store the mobility device comprises a main frame 12 and a platform 13. In reference to FIG. 6-7, the platform 13 is terminally connected to the main frame 12 wherein the platform 13 is perpendicularly positioned to the main frame 12. As a result, the shuttle 11 delineates a L-shape body and easily accessible structure to load and unload the mobility device. Since the main frame 12 is rotatably mounted the distal end 18 of the first arm 15 and the second arm 16, the third rotational axis 25 is positioned across the distal end 18 of the first arm 15 and the second arm 16 and positioned adjacent to the cross plate 19. When the present invention is at the closed position, both the main frame 12 and the platform 13 are angularly positioned atop the base 1, as shown in FIG. 8. When the present invention is at the expanded position, the main frame 12 is positioned perpendicular to the base 1 and the platform 13 is positioned below the base 1 so that the mobility device can be easily loaded or unloaded, as shown in FIG. 12.

Figure 6:
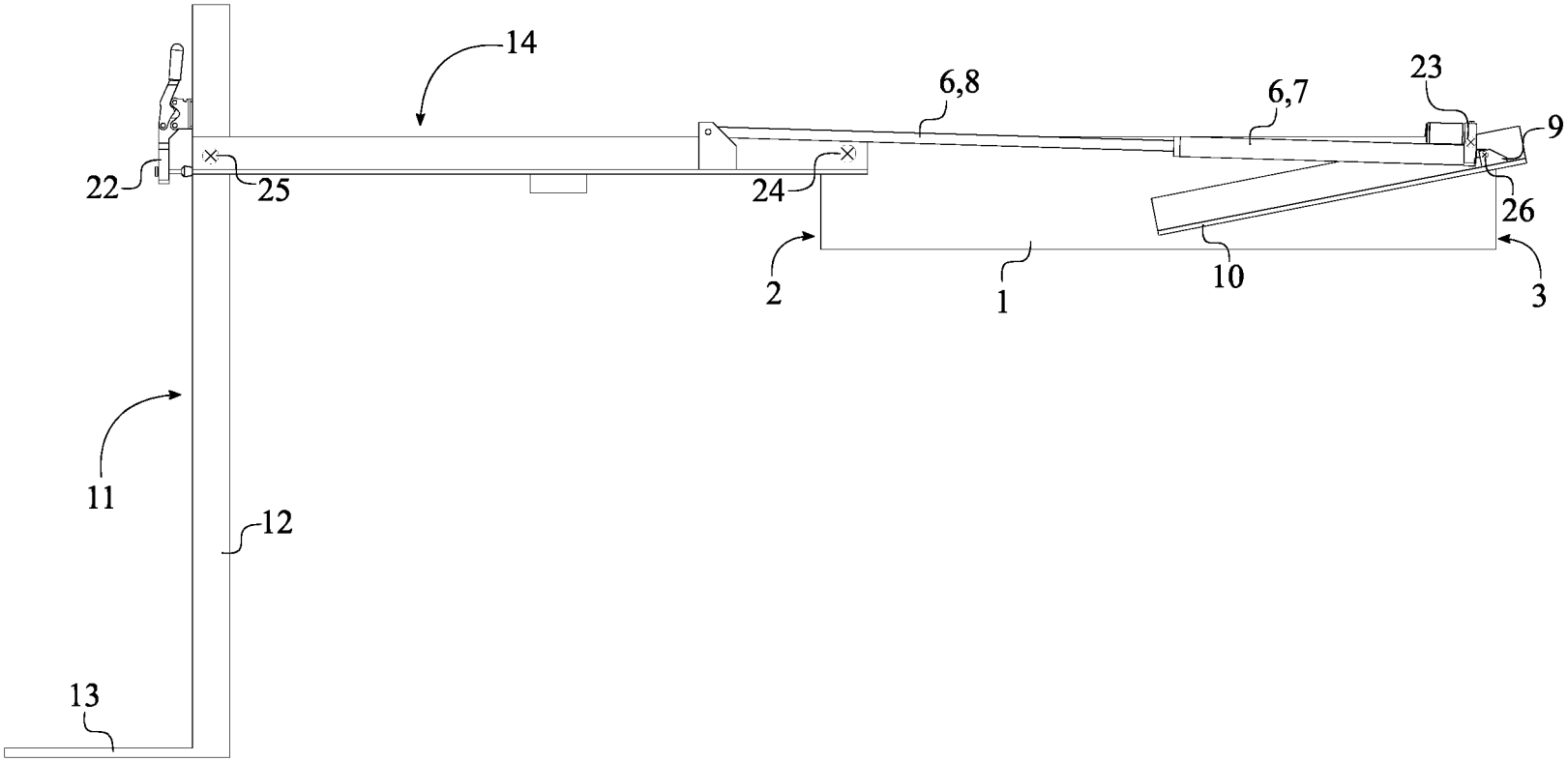
FIG. 6 is a side view of the present invention in the expanded position.

In reference to FIG. 1 and FIG. 6, the present invention further comprises a plurality of clamps 22 that is connected onto the shuttle 11. Preferably, the plurality of clamps 22 is operatively connected on to the main frame 12 thus allowing the mobility device to be secured. As a result, the plurality of clamps 22 is able to eliminate any movement of the mobility device during the loading process, the unloading process, or the transportation process.

The present invention can further comprise a remote control device that is communicably coupled with the linear actuator 6 of the first actuating assembly 4 and the second actuating assembly 5. More specifically, the remote control is able to wirelessly operate the present invention between the closed position and the expanded position.

Although the invention has been explained in relation to its preferred embodiment, it is to be understood that many other possible modifications and variations can be made without departing from the spirit and scope of the invention as hereinafter claimed.

What is claimed is:

1. An apparatus to load and unload a mobility device comprising:

a base;

a first actuating assembly;

a second actuating assembly;

a shuttle, a lift arm assembly;

the first actuating assembly and the second actuating assembly being oppositely positioned of each other about the base;

a linear actuator of the first actuating assembly and the second actuating assembly being rotatably mounted to the base about a first rotational axis;

the lift arm assembly being rotatably mounted to the base about a second rotational axis;

the linear actuator of the first actuating assembly and the second actuating assembly being operatively coupled to the lift arm assembly;

the shuttle being rotatably mounted the lift arm assembly about a third rotational axis;

the first rotational axis being perpendicularly positioned across a rear end of the base;

the second rotational axis being perpendicularly positioned across a front end of the base;

the first actuating assembly and the second actuating assembly each further comprising a pivot kick arm;

a fourth rotational axis being positioned across the pivot kick arm of the first actuating assembly and the second actuating assembly;

the fourth rotational axis being positioned adjacent to the first rotational axis;

the fourth rotational axis being positioned offset from the first rotational axis; and the first rotational axis and the second rotational axis being positioned coplanar to each other.

2. The apparatus to load and unload a mobility device as claimed in claim 1 comprising:

the first actuating assembly and the second actuating assembly each further comprising a push bracket;

the push bracket and the linear actuator being positioned along the pivot kick arm;

the push bracket being hingedly mounted to a housing of the linear actuator;

the push bracket being connected onto the pivot kick arm;

the housing of the linear actuator being rotatably mounted to the base about the first rotational axis; and the lift arm assembly being rotatably mounted to a telescopic rod of the linear actuator.

3. The apparatus to load and unload a mobility device as claimed in claim 2 comprising:

the push bracket being hingedly mounted to the housing of the linear actuator about the fourth rotational axis.

4. The apparatus to load and unload a mobility device as claimed in claim 1 comprising:

the lift arm assembly comprising a first arm, a second arm, a cross plate, a first stop, and a second stop;

the first arm and the second arm being positioned parallel to each other about the cross plate;

the cross plate being terminally connected to the first arm;

the cross plate being terminally connected to the second arm;

the cross plate being positioned adjacent to a distal end of the first arm and the second arm;

a proximal end of the first arm being rotatably mounted to the base about the second rotational axis;

a proximal end of the second arm being rotatably mounted to the base about the second rotational axis;

the first stop being laterally connected to the first arm;

the first stop being oriented toward the base;

the second stop being laterally connected to the second arm; and the second stop being oriented toward the base.

5. The apparatus to load and unload a mobility device as claimed in claim 4, wherein a distance between the first stop and the second stop is smaller than a width of the base.

6. The apparatus to load and unload a mobility device as claimed in claim 1 comprising:

the shuttle comprising a main frame and a platform;

the lift arm assembly comprising a first arm, a second arm, and a cross plate;

the platform is terminally connected to the main frame;

the platform being perpendicularly positioned to the main frame;

the main frame being rotatably mounted a distal end of the first arm and the second arm about the third rotational axis;

the third rotational axis being positioned across the distal end of the first arm and the second arm; and the third rotational axis being positioned adjacent to the cross plate.

7. The apparatus to load and unload a mobility device as claimed in claim 1 comprising:

a plurality of clamps; and the plurality of clamps being connected onto the shuttle.

* * * * *